US007163463B2

(12) United States Patent
Mills

(10) Patent No.: US 7,163,463 B2
(45) Date of Patent: Jan. 16, 2007

(54) GOLF CLUB WITH RIGHT ANGLED HOSEL

(76) Inventor: Truett P. Mills, 1310 Forest Oaks La., Tuscaloosa, AL (US) 35406

( * ) Notice: Subject to any disclaimer, the term of this patent is extended or adjusted under 35 U.S.C. 154(b) by 0 days.

(21) Appl. No.: 10/718,388

(22) Filed: Nov. 20, 2003

(65) Prior Publication Data

US 2004/0102254 A1 May 27, 2004

Related U.S. Application Data

(63) Continuation-in-part of application No. 10/154,114, filed on May 23, 2002, now abandoned.

(51) Int. Cl.
*A63B 53/02* (2006.01)
*A63B 53/04* (2006.01)

(52) U.S. Cl. ..... 473/244; 473/251; 473/305; 473/313; 473/340

(58) Field of Classification Search ..... 473/305–314, 473/324–350, 219–255, 286; D21/736–746
See application file for complete search history.

(56) References Cited

U.S. PATENT DOCUMENTS

| | | | | | |
|---|---|---|---|---|---|
| 1,291,967 | A | | 1/1919 | McDougal | |
| 1,705,250 | A | | 3/1929 | Hincks | |
| 2,478,468 | A | * | 8/1949 | Drake | 473/313 |
| 2,820,638 | A | * | 1/1958 | Morrison | 473/252 |
| 3,081,087 | A | * | 3/1963 | Redd | 473/306 |
| D202,504 | S | * | 10/1965 | Citro | D21/736 |
| D216,031 | S | | 11/1969 | Blake | |
| 3,539,184 | A | | 11/1970 | Koorland | |
| 3,632,112 | A | | 1/1972 | Jacobs | |
| 3,841,639 | A | | 10/1974 | Werner | |
| D235,668 | S | | 7/1975 | Swash | |
| 3,954,265 | A | | 5/1976 | Taylor | |
| 3,967,826 | A | | 7/1976 | Judice | |
| 4,111,426 | A | * | 9/1978 | Goodwin | 473/260 |
| 4,508,342 | A | | 4/1985 | Drake | |
| 4,540,178 | A | * | 9/1985 | Johnson et al. | 473/335 |
| 4,650,191 | A | | 3/1987 | Mills | |
| 4,815,739 | A | | 3/1989 | Donica | |
| 4,819,943 | A | | 4/1989 | Szczepanski | |
| 4,909,515 | A | * | 3/1990 | Redkey | 473/236 |
| 5,533,728 | A | | 7/1996 | Pehoski et al. | |
| 5,542,666 | A | * | 8/1996 | Chou | 473/314 |
| 5,616,087 | A | * | 4/1997 | Bothwell | 473/316 |
| 5,653,645 | A | * | 8/1997 | Baumann | 473/305 |
| 5,690,556 | A | | 11/1997 | Condon | |
| 5,733,203 | A | | 3/1998 | Middleton | |
| 5,749,791 | A | | 5/1998 | Passeri, Jr. | |
| 5,803,824 | A | * | 9/1998 | Rollingson | 473/246 |
| 5,830,078 | A | | 11/1998 | McMahan | |

(Continued)

*Primary Examiner*—Sebastiano Passaniti
(74) *Attorney, Agent, or Firm*—J. Bennett Mullinax, LLC

(57) ABSTRACT

A golf club is provided in which a front heel face of the club defines a bore for receiving one end of a hosel, the hosel defining a substantially right angled bend. A free end of the hosel engages the putter shaft. The hosel provides a desired offset distance from the club strike face. Rotation of the hosel relative to the bore also provides an adjustment mechanism by which the lie angle and face balancing of the club may be achieved. Shaft inserts are also provided to adjust lie angles and offset distances.

11 Claims, 10 Drawing Sheets

U.S. PATENT DOCUMENTS 5,851,155 A * 12/1998 Wood et al. ..... 473/246
5,851,157 A * 12/1998 Koide et al. ..... 473/305
5,873,790 A * 2/1999 Yeh ..... 473/305
5,910,055 A * 6/1999 Bennett ..... 473/305
5,931,741 A * 8/1999 Fenton, Jr. ..... 473/305
6,001,028 A 12/1999 Tang
6,004,222 A 12/1999 Moody
6,080,070 A 6/2000 Whitley
6,095,929 A * 8/2000 Clark ..... 473/248
6,142,884 A * 11/2000 Yim ..... 473/248
6,171,203 B1 * 1/2001 Huang ..... 473/305
6,287,215 B1 * 9/2001 Fisher ..... 473/309
6,319,146 B1 11/2001 Mills
6,371,865 B1 * 4/2002 Magliulo ..... 473/256
6,527,649 B1 * 3/2003 Neher et al. ..... 473/248
6,648,771 B1 * 11/2003 Mills ..... 473/244

* cited by examiner

GOLF CLUB WITH RIGHT ANGLED HOSEL

RELATED APPLICATIONS

This application is a continuation-in-part of U.S. application having Ser. No. 10/154,114, filed on May 23, 2002, now abandoned and which is incorporated herein by reference in its entirety.

FIELD OF THE INVENTION

This invention relates to a golf club and, more specifically, to improvements in putters, irons, and woods which enables a customized lie angle offset and improved hosel location to be provided. Further, this invention relates to a method of assembling a putter having an adjustable lie angle and offset.

BACKGROUND OF THE INVENTION

A golfer's putting form and swing technique varies with every player having his or her own unique style. Traditionally, a golfer selects a club that matches his or her own style. Further, golfers often require clubs that are customized to the physical attributes of the golfer For instance, a golfer's posture, height, and length of arms, legs, and torso all have bearing on a golfer's putting style and selection of preferred types of clubs.

There remains room for variation and improvement in the art directed towards putters, woods, and irons which allows for a lie angle and/or offset to be individually set for a golfer. Moreover, there remains a need within the art for the customized improvement which is compatible with existing golf club heads such that existing club heads may be adapted to allow for the lie angle and offset adjustments in accordance with the present invention. Further, there remains room for variation and improvement directed to the design of irons and woods which improve the performance of the clubs. Additionally, the resulting clubs should be aesthetically pleasing and comfortable for the golfer to use.

SUMMARY OF THE INVENTION

It is an object of one of the present embodiments to provide a golf club having an adjustable lie and offset which may be adjusted to permit customization by the club manufacturer to an individual golfer.

It is still another aspect of at least one of the present embodiments to provide a right-angled hosel extending from the heel or a notched heel surface of the front face of a club.

It is yet another aspect of at least one of the present embodiments to provide inserts for a club shaft, the inserts providing for a variation and customization of a golf putter in which an angled insert is placed within a cut portion of the putter shaft. By reattaching the shaft ends to respective ends of the angled insert, the lie angle of the putter may be adjusted.

It is yet another aspect of at least one of the present embodiments to provide a club iron or driver having a hosel extending perpendicularly from a face of the iron.

It is yet another aspect of at least one of the present embodiments of the invention to provide a club iron and a method of manufacturing a club iron in which a heel portion of the club iron is angled with respect to the face of the iron. A hosel extends substantially perpendicular from either a front or rear of the heel portion. The hosel may provide an angled bend which may determine in part the desired lie angle and allow an offset distance to be established for the iron.

It is yet another aspect of at least one of the present embodiments of the invention to provide a club iron in which the iron club head defines a heel portion which defines an elevated tab extending from the heel. The elevated tab is adapted for receiving a bore for a hosel. The elevated tab positions the hosel away from the iron sole, thereby maintaining the hosel in a position along an approximate midline of the club face.

It is yet another aspect of at least one of the present embodiments to provide for a club iron in which a face of the iron club heel defines a bore extending into the heel face. Adjacent the bore is a wedge-shaped member defining a bore therethrough, the bore of the wedge-shaped member aligning with the bore defined in the heel. The combination of the wedge and the heel bore define a structure for receiving the hosel insert.

It is yet another aspect of at least one of the present embodiments of the invention to provide for a club iron in which the club heel defines a tapered heel tab which is parallel to the heel face. The tab or projection is adapted for receiving an angled hosel into its face. The tab of the heel may be positioned at a desired loft angle measured with respect to the striking face of the iron, the angle defining the loft angle of the club.

It is yet another aspect of one of the present embodiments to provide a putter having a hosel extending above a plane defined by a top surface of the putter. A free end of the hosel engages a bore defined along a front edge of a putter heel face. The bore engages one end of a right-angle hosel. The right-angle hosel may be adjusted in terms of both an offset as well as a lie angle to provide a level of customization for a putter.

These and other aspects of the invention are still further provided by a golf club comprising a club head having a front face, a sole, a toe, and a heel, the heel defining a bore extending into at least one of a front surface or a rear surface of the heel; and an angled hosel having a first end inserted into the bore and a second end attached to a shaft.

These and other aspects of the invention are still further provided by a golf club head for an iron-type golf club comprising a golf head portion having a front face, a sole, a toe, and a heel portion; and, an aperture defined in a front face of a heel portion, the aperture having an axis substantially perpendicular to the heel face surface.

These and other features, aspects, and advantages of the present invention will become better understood with reference to the following description and appended claims.

BRIEF DESCRIPTION OF THE DRAWINGS

A fully and enabling disclosure of the present invention, including the best mode thereof, to one of ordinary skill in the art, is set forth more particularly in the remainder of the specification, including reference to the accompanying drawings.

DETAILED DESCRIPTION OF PREFERRED EMBODIMENTS

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus or process pathway. To avoid redundancy, detailed descriptions of much of the apparatus once described in relation to a figure is not repeated in the descriptions of subsequent figures, although such apparatus or process is labeled with the same reference numbers.

Figure 1:
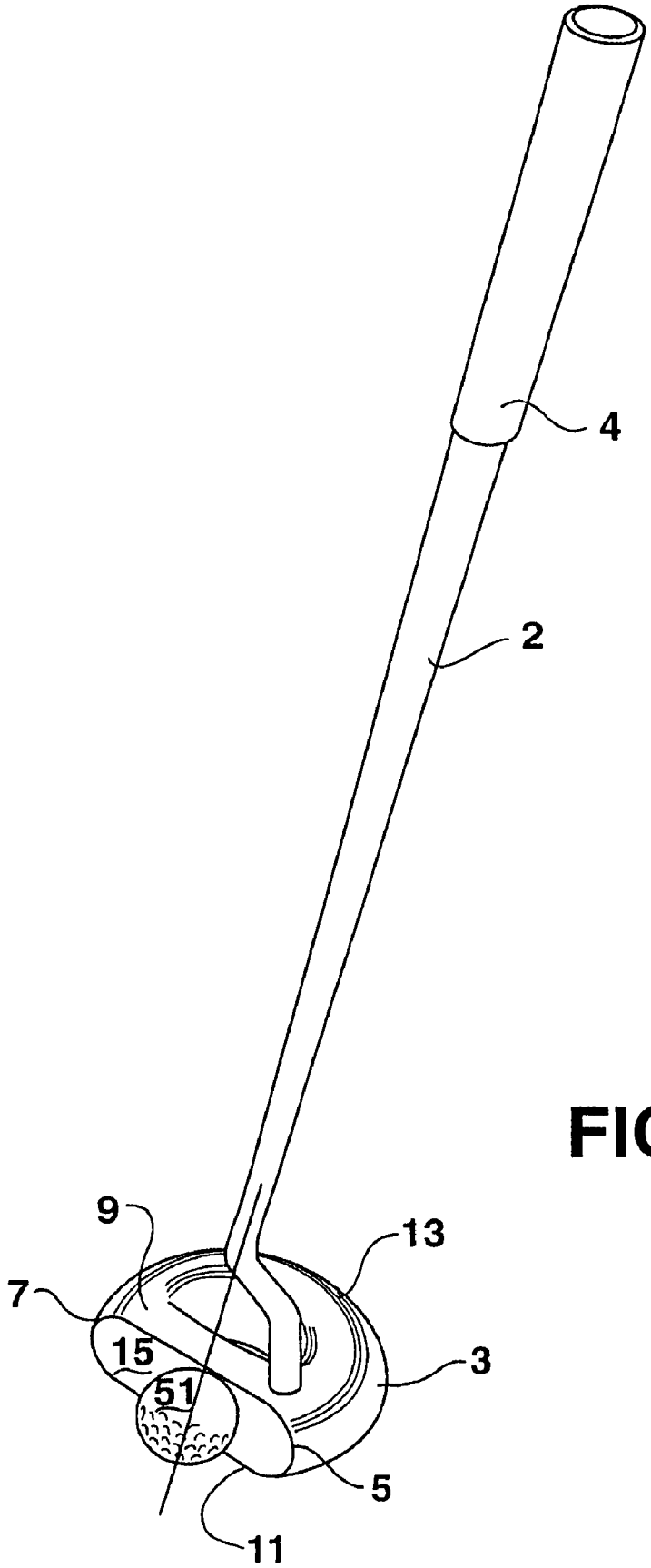
FIG. 1 shows a configuration of a putter.

As seen in reference to FIG. 1, a golf putter is provided having a shaft 2 with a grip 4 fixed to one end and a blade-type putter head 3 fixed to the other end. The putter head generally has a heel 5, a toe 7, a top 9, a sole 11, a rear side 13, and a face 15 which is used to strike a golf ball 51. The connecting end of shaft 2 may be attached to the putter head 3 in any conventional manner.

As used herein and in reference to the Figures, the term "lie angle" refers to the angle between the longitudinal axis of the club shaft and a horizontal reference plane such as that defined by a sole of the club head. Positioning the correct lie angle for an individual ensures that the club head is properly angled relative to the putting surface and ball during the putting stroke or club swing. A proper ball strike requires that the longitudinal axis of the club head be properly angled relative to the putting surface. This positioning will better ensure that the face of the putter head strikes the ball in a proper position. If the lie angle is improperly positioned, there is a risk that the toe or the heel of the club head will catch on the putting surface and cause misalignment of the club face when the ball is struck.

As used herein, the term "offset" refers to the shortest horizontal distance between the longitudinal axis of the main shaft portion and the edge of the club head face. The longitudinal axis of the club shaft, if extended as an imaginary line, extends to a position in front of the face of the club head such as a putter. This arrangement, known as a forward offset, places the shaft axis forward of the face of the putter. This placement is favored by many golfers in that the golfer's hands will be in front of the ball at the point of impact of the putting stroke. Many golfers believe this arrangement is preferred and that it provides an improved feel for the putt and increases accuracy of the putt since the club face may strike a ball above a center line of the ball, thereby providing initial topspin to the ball. The initial topspin helps maintain the ball on a straight line and reduces the effects of surface irregularities on the putting green.

A forward offset is easier for most putters to visually align their putts. Further, a forward offset provides improved stability of the putter. The offset provides yet a further increase in the moment of inertia by increasing the distance between the putter head mass and the shaft axis of rotation. The increase in the moment of inertia corresponds with an increase in the putter head's resistance to twisting when a golf ball is struck off-center from the putter face's "sweet spot". The twisting of the putter face is undesired in that the ball's direction of travel will vary from the intended putt direction.

Figure 2A:
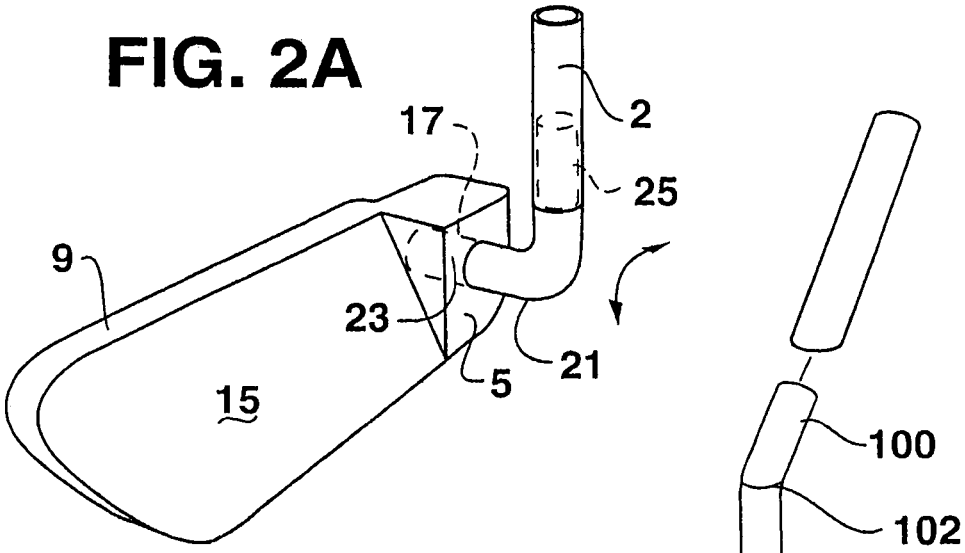
FIGS. 2A–2C illustrate an embodiment of a putter according to the present invention using right-angled hosels in combination with optional angled inserts set into cut portions of the putter shaft.
Figure 2B:
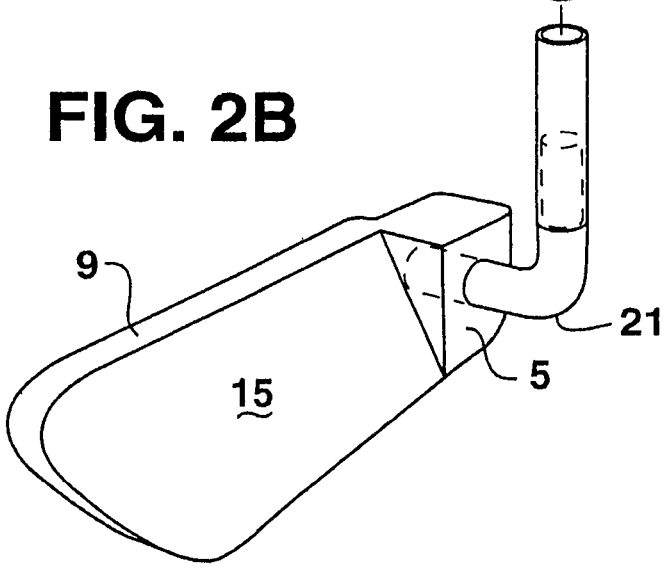
Figure 2C:
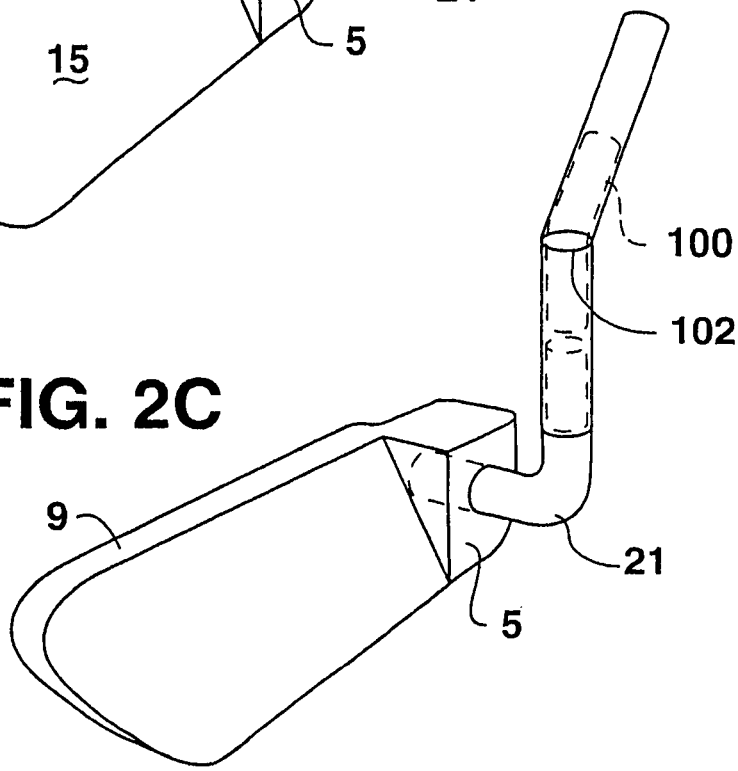
Figure 5:
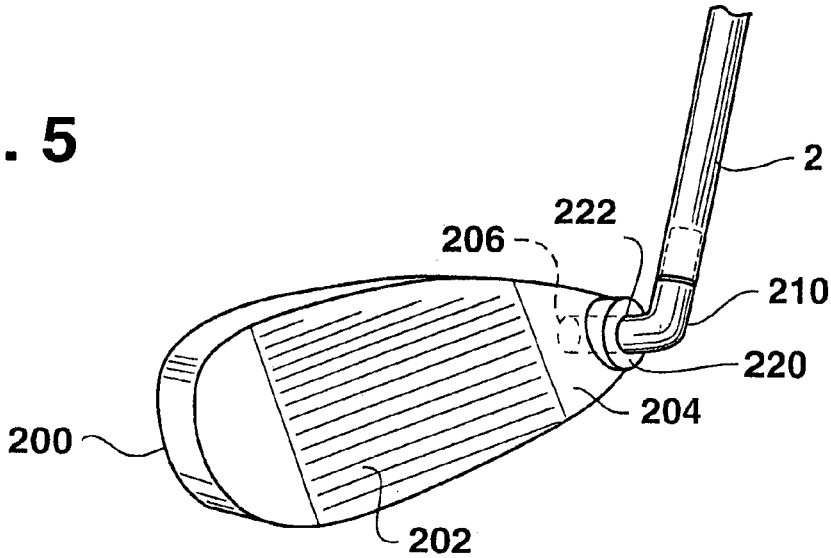
FIGS. 5–9 are directed to non-putter clubs using right-angled hosels along with optional wedge-shaped inserts so as to provide a golf club having an adjustable lie angle and offset.

As best seen in reference to FIGS. 2A–2C, one embodiment of the putter head has a substantially right-angled hosel 21 carried by the putter head and has a first portion 23 which is inserted into bore 17 of heel 3. While the first hosel portion is shown inserted perpendicular to the heel face, other orientations could be used. A second hosel portion 25 is adapted for receiving a hollow shaft, the second end 25 being curved to form a substantially right-angle elbow. The right-angled hosel is described further in the inventor's U.S. Pat. No. 6,319,146 B1, and co-pending application having Ser. No. 10/018,120, both of which are incorporated hereby by reference in their entirety.

As seen in reference to FIG. 2A, the lie angle may be adjusted by rotating the right-angled hosel 21 relative to putter head 3 as seen by the directional arrow.

As seen in reference to FIGS. 2B and 2C, the shaft 2 may be cut along a portion of its length and have inserted therein an angled insert 100. The angled insert 100 is designed to mate snugly with the respective interior portions of the cut shaft 2 such that the respective cut ends of the shaft are thereafter repositioned in close proximity. As best seen in reference to FIG. 2B, angled insert 100 may define a collar 102 having a slightly increased thickness and/or diameter with respect to insert 100. The collar 102 may make contact with the respective cut ends of the shaft when the insert is properly installed.

The insert 100 may be formed of a solid piece of metal which is curved at a desired angle. The angle of the curve and orientation within the shaft portions may be used to establish a desired lie angle.

While the above embodiment is directed to a modification of a straight shafted putter attached to a right-angled hosel (FIG. 2A), the angled insert may be used with any putter shaft, i.e., a straight shaft, a single bend shaft, or a double bend shaft so as to establish a lie angle and/or offset. FIGS.

Figure 4:
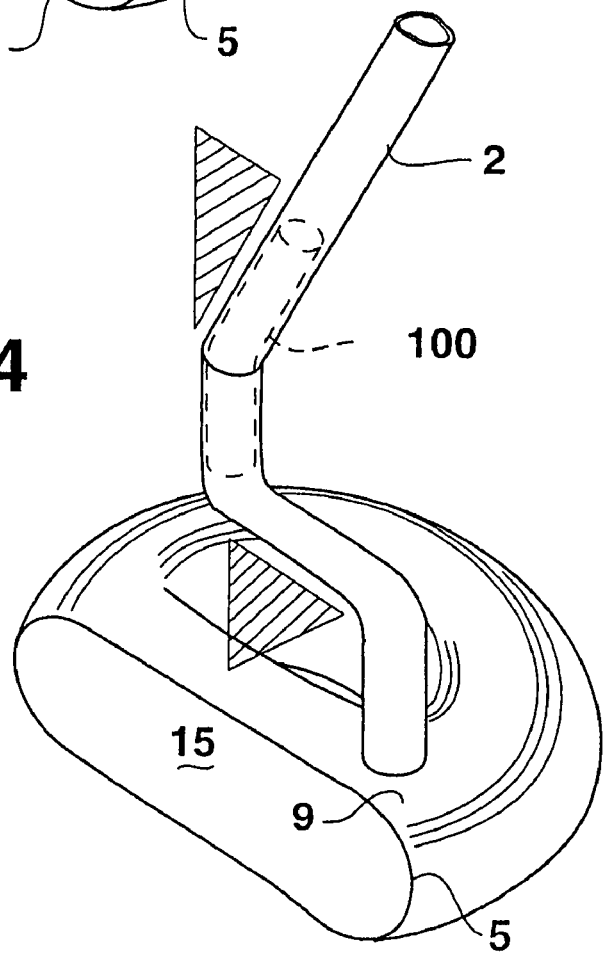
FIG. 4 is an alternative embodiment of an insert used in conjunction with a putter shaft.

1 and 4 illustrate double bend shafts. As seen in FIG. 4, the insert may be positioned in a straight portion of the shaft, adjacent the uppermost bend.

The cut shaft is reattached to the insert 100 using adhesives and/or other conventional means as may be used when securing a shaft to a male hosel member. The use of the insert 100 can also be used to establish an offset to the main axis of the shaft. In one embodiment of the invention, the insert is used in conjunction with a conventional single bend shaft. The bend of the shaft can be used to provide a desired offset or lie angle as is known in the art. The insert 100 may be used to establish either a desired lie angle and/or an offset with respect to the putter. For instance, with a single bend or a double bend shaft, an insert may be used above the bend so as to direct the axis of the shaft according to the positioning of the insert. In this manner, a lie angle may be established based upon the orientation of the angled insert. Additionally, an angled insert may be used to provide an offset.

In order to conform to the rules and regulations of professional golf, it is necessary that the insert and any angles or bends occur within 5 inches as measured vertically from the sole of the club.

Figure 3:
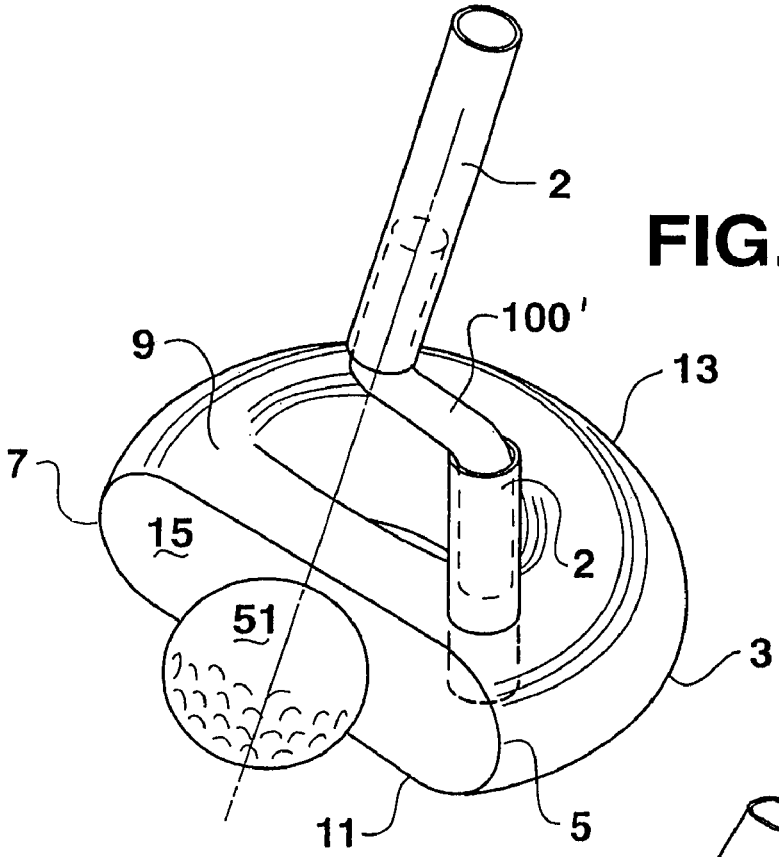
FIG. 3 sets forth an alternative embodiment of an angled insert in which an angled insert provides a method of adjusting a straight putter shaft to a configuration similar to a bent shaft seen in reference to FIG. 1.

An additional embodiment of an angled insert may be seen in reference to FIG. 3 in which insert 100' provides for two angles connected by an intervening straight portion of the insert. The relative positioning of the insert within the cut shaft 2 may be used to adjust the offset and lie angle of the club and to bring about desired face balancing of the club.

As seen in reference to FIG. 4, the angled insert 100 may be used in conjunction with a double bend putter shaft or in conjunction with a shaft attached to a club by an angled hosel.

The insert 100 facilitates a bent angled shaft which allows the putter to be face balanced. A shaft may be bent at its lower end, in conformity to the rules of golf as defined by the United States Golf Association, such that the shaft bend locates the longitudinal axis of the shaft, defined by the straight portion of the shaft, so that the axis will pass through the center of gravity of the putter head (center shafted).

The embodiments seen in reference to FIGS. 2A–4 illustrate that existing putters may be easily retrofitted in accordance with the present invention. As illustrated, the angled insert may be used with any conventional shaft and putter head arrangement. The process involves cutting the shaft along a portion of its length, inserting the insert having a desired angle, positioning the direction of the angle to achieve the desired lie angle and/or offset, and then reattaching the cut portions of the shaft along the insert.

The embodiments discussed above provide advantages for the manufacturer or retailer of the putter. The present invention permits the lie angle, offset, and face balancing of a putter to be adjusted to a variety of settings to meet the needs of a broad range of golfers. These adjustments can be done with virtually any putter head and shaft. Therefore, with a minimal number of basic components, a full range of putters having varying characteristics can be provided. While the illustrated embodiments envision that a right-angle hosel may be used in conjunction wit the inserts, it is readily understood and appreciated that any conventional hosel arrangement may be used. The inserts are used to bring about changes in the shaft alignment relative to the club. Since the inserts are inserted into a portion of the shaft, the inserts may be used with virtually any type of club/hosel/shaft arrangement and are not limited to the illustrated embodiments seen and described above.

Set forth in FIGS. 5–9 are embodiments directed to improvements in the construction of irons and drivers. As best seen in reference to FIG. 5, an iron head 200 having a ball striking face 202 further provides a heel portion 204. Heel 204 defines a bore 206 extending from a front face of the heel and into the adjacent body of the iron head 200. The bore 206 may be perpendicular to the heel face or placed at an angle to vary the face loft of the club. Bore 206 is used to engage a hosel 210. Optionally, a wedge-shaped member 220 is integrally attached by a casting or molding operation to the iron heel face 204. Wedge-shaped member 220 defines a bore 222 which is coextensive with bore 206.

Figure 6:
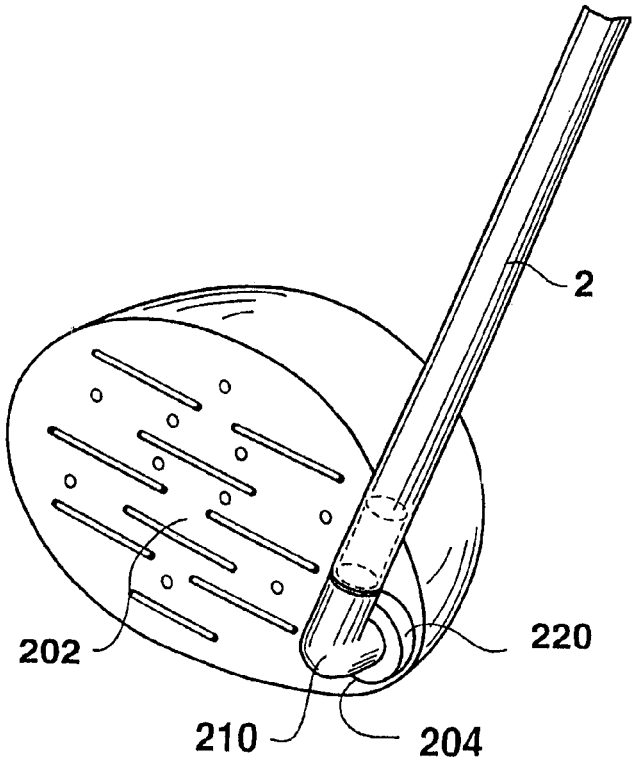

FIG. 6 is an exemplary embodiment directed to a wood having a strike face 202. A heel portion 204 defines an aperture through which an angled hosel 210 may be inserted. If desired, a wedge-shaped member 220 with a corresponding bore therethrough may be used to additionally receive the hosel 210. The bore defined by the heel face may be substantially perpendicular to the heel face. In this embodiment, the loft angle of the resulting wood may be provided by either the angled face of the wood and/or in combination with an angle defined by the hosel 210. While hosel 210 is seen in the form of a right-angle hosel, the right angle may be varied by a few degrees so as to vary the resulting lie angle and/or face loft of the wood. Alternatively, the bore defined by the heel face may be provided at a non-perpendicular orientation. The relative angle between the bore and the club face can be used to vary or establish the desired loft angle and/or lie angle of the club.

Figure 7:
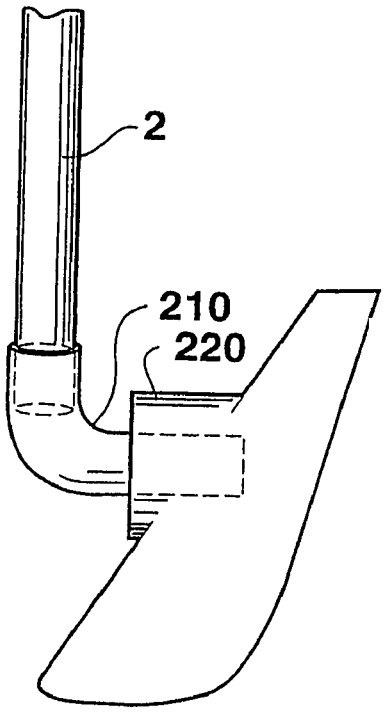
Figure 8:
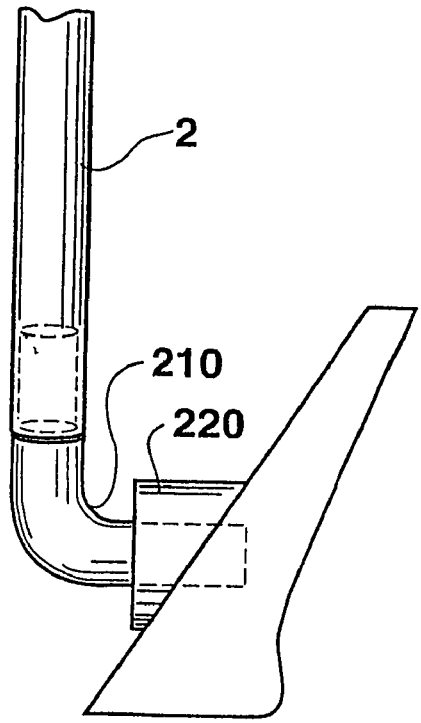

As seen in reference to FIGS. 7 and 8, a heel view of two different embodiments of an iron are seen in which a separate hosel is used to secure the shaft 2 using either a male or a female type connection of the hosel to the club shaft. The front face of the wedge-shaped member 220 is substantially perpendicular to the bore 222 and the associated inserted hosel end. A rear face of member 220 defines an angled surface which conforms to the angle of the heel face 204.

The arrangement of the hosel to the heel face is an improvement over conventional iron or wood club head designs. Typical irons provide a molded hosel which is unadjustable and which is often positioned along the surface of the iron face and extends below a center line of the iron head. As such, the typical hosel will often dig in with respect to the playing surface and interferes with a player's swing.

The present invention elevates the hosel with respect to a typical integral hosel/iron or hosel/wood arrangement. Further, the use of a separate and removable hosel provides less drag and avoids the hosel making contact with the playing surface should the sole/heel portion of the iron make contact with the playing surface. Further, elevating the hosel with respect to the iron or wood heel reduces the occurrences of a shank shot. An additional advantage is that the hosel arrangement of the illustrated embodiments allow for a simple adjustment and/or customization of a lie angle by varying the angle defined by the hosel 210. Further, the length of the inserted portion of hosel 210 permits a range of desired offsets with respect to the iron face.

While a right-angle hosel 210 is illustrated, the angle of hosel 210 may be varied from 90° depending upon the desired loft of the club or desired lie angle.

Figure 9:
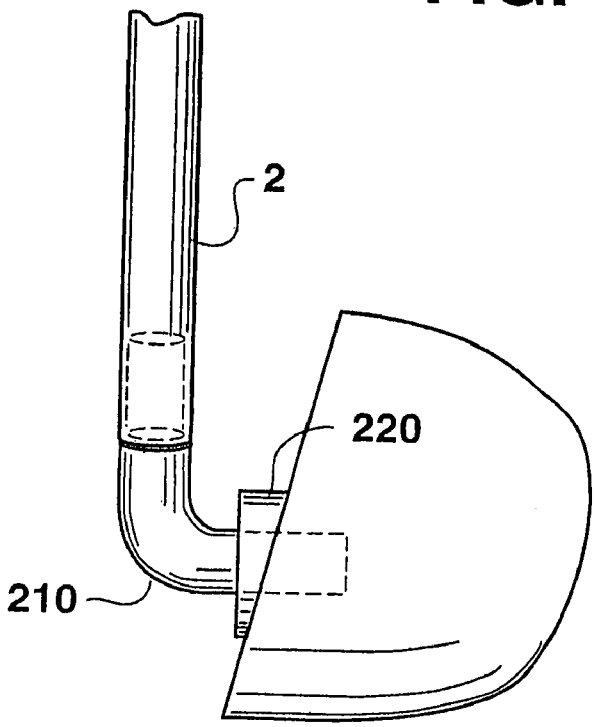

As seen in reference to FIGS. 6 and 9, a driver can be provided with a hosel which extends from a bore defined within a heel surface of the driver club. If desired, the heel of the driver may define a recessed notch in the heel face where the hosel bore may be located. In such an arrangement, the notch allows the hosel and shaft to reside within the notch so that the hosel and shaft do not extend beyond a plane defined by the striking face of the wood.

Figure 10:
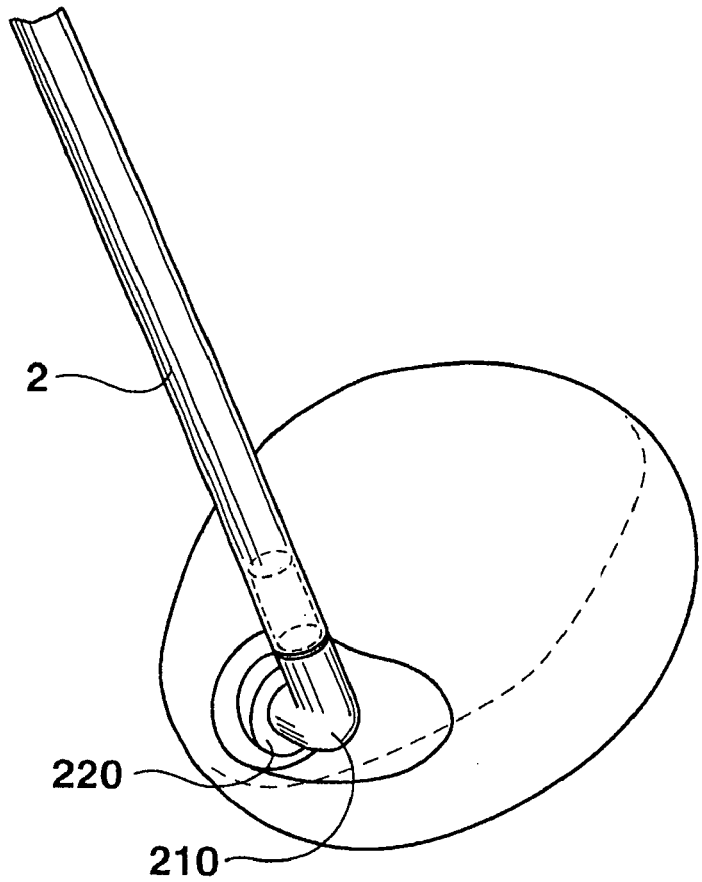
FIG. 10 is an alternative embodiment of a golf club in which a right-angled hosel is inserted into a rear heel of the club.

As seen in reference to FIG. 10, it is envisioned that a golf club including putters, drivers, and irons can be provided with a hosel which extends from a rear heel surface of the club head. If desired, a notched or recessed surface may be used to secure the hosel to the corresponding bore define by the rear heel. The angled member 220 may also be used to help secure and fasten the hosel to the club head. Surprisingly, it has been found that many of the attributes and improvements associated with a right-angled hosel on the face of a putter or other club are also maintained with the hosel is positioned along the rear heel of the club head. Further, placement of a hosel in the rear heel provides an unobstructed view of the strike face of the club.

Figure 11:
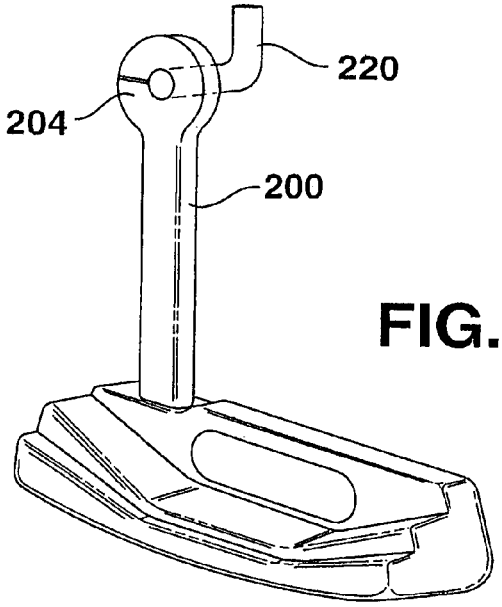
FIGS. 11–13 are directed to an alternative embodiment of a putter having a right-angle insert.
Figure 13:
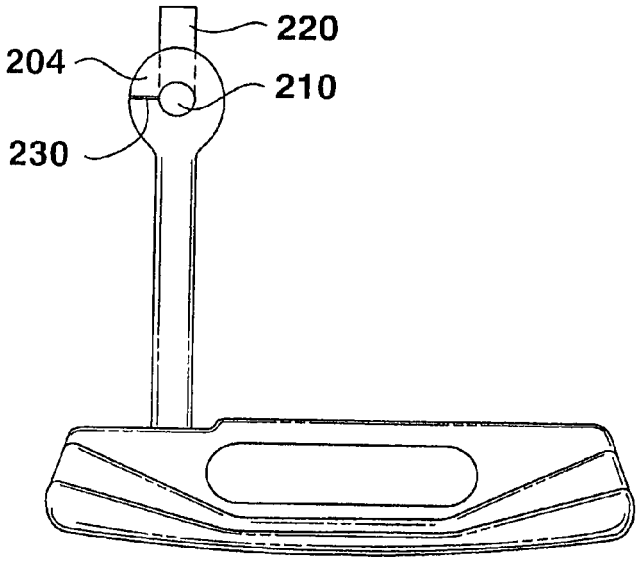
Figure 12:
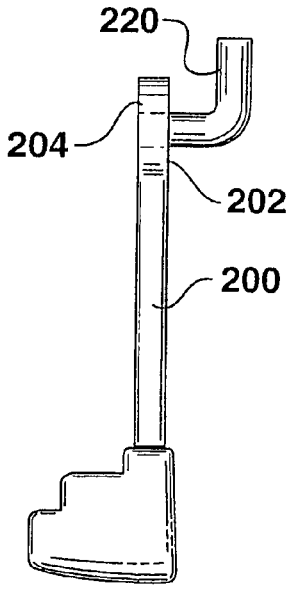

An alternative embodiment of a putter using an angled hosel is seen in reference to FIGS. 11–13. As seen in the respective figures, a putter head of any conventional design and configuration may define a stem portion 200 which extends above a top surface of the putter. An upper portion of the stem portion 200 defines a bore 210 which may extend from a front side 202 to a rear side 204 of the stem 200. An angled hosel, such as a right-angle hosel 220, may be inserted into the bore 210. A set screw 230 of conventional design may be used to secure the hosel 220 within the bore 210.

As is readily apparent, the embodiment described above provides an easily adjusted mechanism for customizing a desired lie angle for a putter. In addition, the length of the various arms of the hosel 220 and/or the degree of insertion of the hosel into bore 210 may be used to provide a desired amount of offset for the putter. This particular design offers immense improvements over conventional putter construction using fixed integral hosels. Manufacturers of such conventional fixed hosel putters must manufacture putter heads of multiple design and mold configurations so as to accommodate variations in lie angles and offset for purchasers of their products. The use of the right-angled hosel in connection with an elevated stem positioned above the putter head allows a single putter head design to be rapidly and easily adjusted for both lie angle and offset by simple positioning of the hosel.

Figure 14:
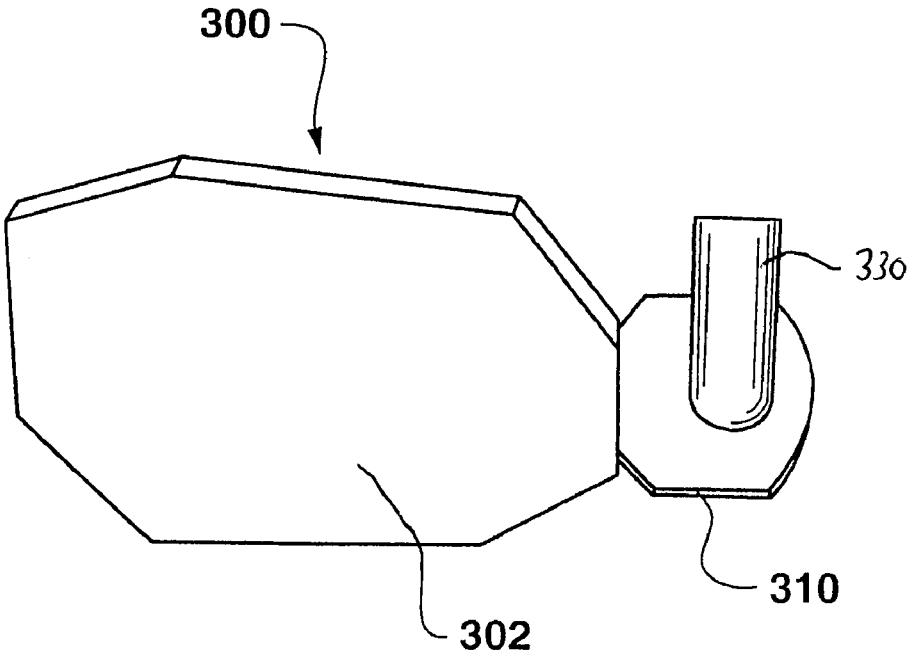
FIGS. 14–17 are directed to embodiments of a club iron in which the heel of the club iron is adapted for receiving an angled hosel which extends from a bore defined in the front heel face of the club iron.
Figure 15:
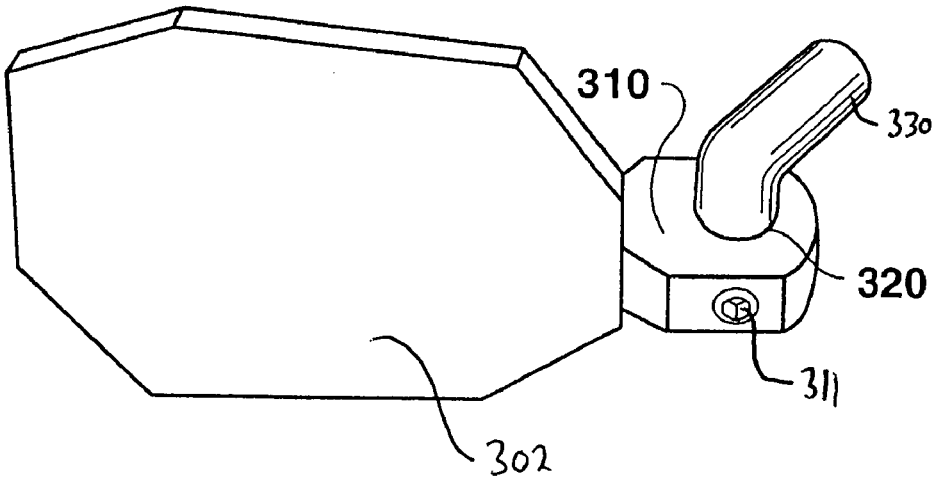
Figure 16:
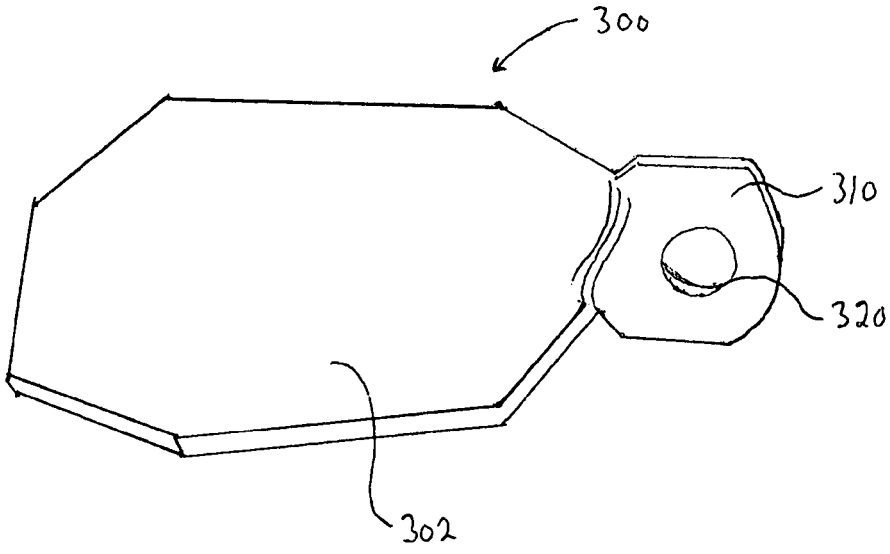

An alternative embodiment of a club iron is seen in reference to FIGS. 14–16. FIGS. 14 and 15 illustrate an iron 300 having a front face 302. While not separately illustrated, front face 302 may define any number of surface textures and designs as are typically used on the face of conventional irons. A heel portion 310 is provided in which the heel portion has an overall height less than the height of the strike face portion of the iron. Additionally, the heel portion 310 is elevated above a support surface when a sole of the iron engages the turf or other flat support surface. A face of the heel 310 defines a bore 320 which may extend through a rear surface of the heel 310. An angled hosel 330 is used to connect the iron to an appropriate club shaft.

As seen in reference to FIGS. 14–16, the relative angle between a surface of heel portion 310 and the front face 302 of the iron may be varied. The degree of angle molded or otherwise permanently affixed between these two surfaces will define the loft angle of the respective iron. As discussed with respect to earlier embodiments of clubs and irons, use of an angled hosel such as a right-angled hosel 330 allows for additional adjustments and customization of the lie angle between the club and the shaft. Additionally, the amount of offset provided for the iron can be varied by controlling the extent, if any, by which the hosel extends beyond the front face surface 302 of the iron. For instance, it is envisioned that the offset need not extend past the face of the club iron and may include configurations where a portion of the heel face surface is notched adjacent the bore or otherwise defines a recessed surface which partially receives a portion of the hosel and/or accompanying shaft so as to reduce the likelihood of a shank shot. It should be noted that the relative angle between the face of heel portion 310 and face 302 in FIG. 15 is exaggerated for the purposes of illustration of set screw 311 used to secure hosel 330. Actual face loft between the two surfaces would bring face 310 forward relative to the main body of the club head in a direction opposite that shown and as best seen in reference to FIG. 16.

As seen in reference to FIG. 16, a front view of the iron head according to the prevent invention provides for a single unitary club head in which the region adjoining the front face 302 to the heel portion 310 provides an aesthetically pleasing and aerodynamic curved profile. The upper edge of heel portion 310 is positioned in front of a plane defined by front face 302. Accordingly, the lower edge of heel portion 310 is positioned beneath a plane defined by face 302. The relative angles between the respective intersecting planes of heel portion 310 and club face 302 may define the club loft when a right angled hosel extends perpendicular to the heel face. The curved profile between the heel and the club face as seen in FIG. 16 can be provided by a mold template such as that seen in the schematic of FIG. 17.

Figure 17:
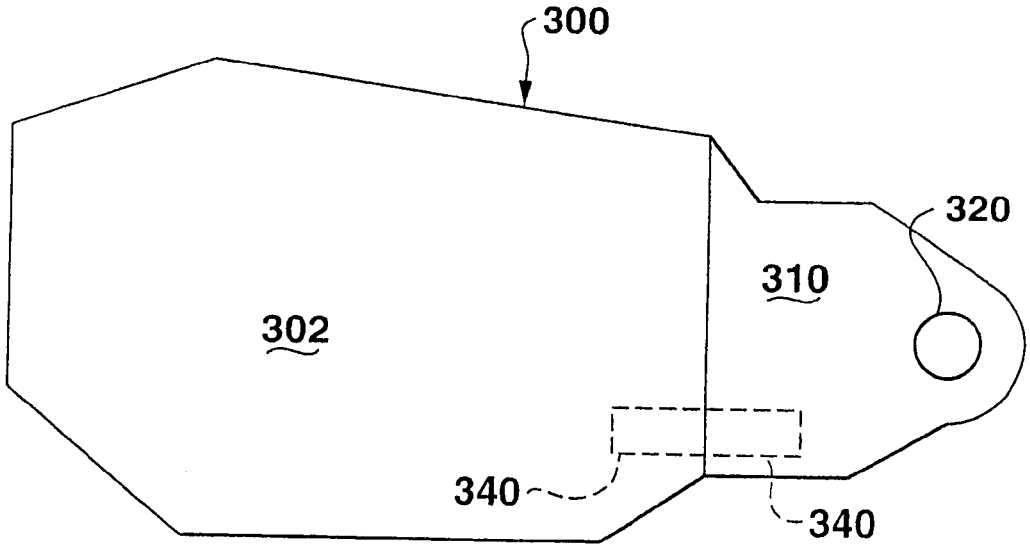

As seen in reference to FIG. 17, the front face 302 of a master model used for producing an iron has a swivel connector 340 to which heel portion 310 is attached. The swivel connector 340 allows the loft angle to be selected as defined as the amount of rotation between the two portions of the iron head and heel portion 310. As the degree of rotation of the portions about the pin is increased, the resulting loft angle of a club manufactured from the master mold or template is likewise increased. Bore 320 is provided for receiving a portion of an angled hosel (not illustrated).

Figure 18:
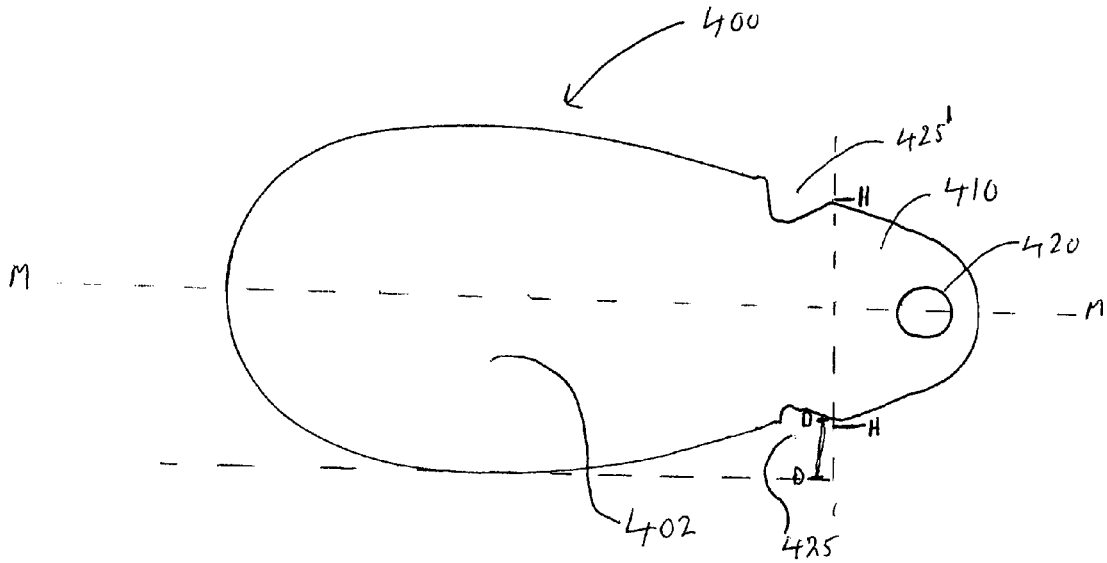
FIG. 18 is an alternative embodiment of a club iron in which a portion of the heel of the club iron is adapted for receiving an angled hosel which extends from a bore defined in the front face of the tab.

As seen in reference to FIG. 18, a front face view of a club, such as a wood or an iron, is referenced and which incorporates several aspects of the present invention. As illustrated, a heel portion 410 of the club head 400 has a height H—H which is less than a height of the main body of the club 400. A bore 420 may be provided within the heel portion 410, bore 420 adapted for receiving a hosel from a front surface of heel 410. If desired, bore 420 may extend completely through the heel portion 410 or be provided only along a rear side of heel 410. The bore 420 may be defined perpendicular to the heel face or at an angle. In either of these alternative embodiments, a hosel may be inserted into and extend from a rear portion of the club head. In a manner analogous to an offset distance, the distance the resulting shaft is positioned from the main body of the club may be determined by the length in which a hosel extends from the club head.

As illustrated, heel portion 410 is positioned above a plane defined by the sole 412 of the club head. In other words, the heel 410 is elevated above a bottom of the sole 412 such that a space or gap region 425 is defined below heel portion 410. As illustrated, a similar gap 425' may be positioned above the heel 410, thereby providing a more symmetrical appearance of the heel 410 relative to the main body portion of the club head.

It has been found that by placing an angled hosel within the bore 420, the resulting club head and golf club has several advantages. One, the hosel is attached to the club head in a manner which elevates the position of the hosel and hosel attachment region away from the sole and lower edge of the club face. As a result, the hosel is elevated a sufficient distance from the club sole that the hosel will not drag into the fairway turf during the swing.

In addition, the position of the hosel provides an improved weight distribution. The angled hosel is of a lighter weight configuration than typical hosels which are embedded within the body of a iron or driver. The improved weight distribution enhances the size of the resulting sweet spot on the club head. Additionally, as seen in reference to the embodiments illustrated in FIGS. 14–18, the hosel may be placed along an approximate midline M—M of the strike face. This position extend the hosel further away from the strike surface of the face and provides for a longer moment of inertia. The increased moment of inertia provides for a more effective hitting surface of the club face in that the club head resists rotation relative to the ball on shots where the club face and ball alignment fall outside the "sweet spot" of the club. The increased resistance to rotation translates to improved shot accuracy in that the reduced club head rotation maintains the intended direction and trajectory of the ball.

Preferably, the respective bores 320 and 420 as seen in reference to FIGS. 14–18 is positioned within about ⅝" of the outer rear edge of heel 410. Additionally, the position of the respective bores are preferably placed along a centerline (M—M, FIG. 18) extending from the toe to the heel of the club.

Where an angled hosel is inserted into the heel face, the angle of the hosel may be used to make customized changes to the resulting club loft. A few degrees difference in the angle of the bent hosel can be used to open up or close down the loft angle defined by the club head. In addition, the heel face may be recessed relative to the strike face of the club, parallel to the club strike face, or positioned at an angle so as to position a heel face plane which intersects with a plane of the strike face.

Additional attributes of the iron club design as set forth in FIGS. 14–18 include the fact that the bore defined in the heel portion 310 may be provided tangential to the surface of the heel face. Such an arrangement between the bore and the heel face may be used to establish a loft or lie angle. In addition, using an adjustable template in which the iron portions are joined by a swivel connector allows any desired loft angle to be readily selected during a manufacturing process. Further, the resulting arrangement for the receipt of the hosel allows for the lie angle to be readily adjusted and customized for an individual golfer. Likewise, the amount of offset, if any, may also be controlled by the dimensions of the separate hosel and the insertion depth of the hosel relative to the bores 320/420.

While many of the figures referenced herein are schematic drawings directed to the location of hosels and relative curvature and positioning of the front face of the various putter, iron, or wood clubs, one having ordinary skill in the art would realize that enormous variation in club head design in keeping with the teachings herein are possible. For instance, the rear side of a putter, iron, or driver may have any number of conventional shapes and designs. In this respect, conventional club head cavities, perimeter weighting systems, and other aspects of a club head design may readily be incorporated into the teachings of the illustrated embodiments.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged, both in whole or in part. Therefore, the spirit and scope of the appended claims should not be limited to the description of the preferred versions contained therein.

The invention claimed is:

1. A golf club comprising:

a club head having a front face, a sole, a toe, and a heel, said heel defining an aperture adapted for receiving a hosel therein and extending through at least one of a front face or a rear face of said heel said heel defining an upper edge and a lower edge, said upper edge and said lower edge being parallel and said heel having a height less than a height of said club head; and, said front face of said heel defining a plane which intersects a plane defined by said front face of said club head.

2. The golf club according to claim 1 wherein said aperture extends from a front surface of said heel.

3. The golf club according to claim 1 wherein said aperture extends from a rear surface of said heel to a front surface of said heel.

4. A golf club comprising:

a club head having a front face, a sole, a toe, and a heel, said heel defining a bore extending into a rear surface of said heel, said heel defining at least one of a front heel face or a rear heel face having a plane which intersects a plane defined by said front face of said club head; and, an angled hosel having a first end inserted into said bore defined by said rear surface of said heel and a second end which extends from said rear heel surface and which is attached to a shaft.

5. A golf club according to claim 4 wherein said club head defines a gap beneath said heel.

6. A golf club according to claim 5 wherein said bore defines a non-perpendicular angle to said at least one of said front surface or said rear surface of said heel.

7. A golf club according to claim 4 wherein said bore is perpendicular to said rear surface of said heel.

8. A golf club according to claim 4 wherein said bore defines a non-perpendicular angle to said at least one of said front surface or said rear surface of said heel.

9. The golf club according to claim 4 wherein a lower edge of said club face defines a plane parallel to a plane defined by a lower edge of said heel face.

10. A golf club comprising:

the club head having a front face, a sole, a toe, and a heel portion;

a hosel extending from an aperture defined by at least one of a front surface or a rear surface of said heel, said at least one front surface or rear surface of said heel further defining a flat planar surface surrounding said aperture, said flat planar surface defining a plane which intersects the plane defined by said front face of said club head, said heel further defining an upper edge and a lower edge, said upper edge and said lower edge being parallel, said heel having a height less than a height of said club head.

11. A golf club comprising:

the club head having a front face, a sole, a toe, and a heel portion;

a hosel extending from an aperture defined by at least one of a front surface or a rear surface of said heel, said at least one front surface or rear surface of said heel further defining a flat planar surface surrounding said aperture, said flat planar surface defining a plane which intersects the plane defined by said front face of said club head, said heel further defining an upper edge and a lower edge, said upper edge and said lower edge being parallel, said heel having a height less than a height of said club head.

* * * * *